US006161918A

United States Patent [19]

Bailey et al.

[11] Patent Number: 6,161,918

[45] Date of Patent: Dec. 19, 2000

[54] THERMAL INK JET PRINTER

[75] Inventors: Thomas Allen Bailey, Frankfort; John Booth Bates; Scott Michael Heydinger, both of Lexington, all of Ky.

[73] Assignee: Lexmark International, Inc., Lexington, Ky.

[21] Appl. No.: 09/187,473

[22] Filed: Nov. 6, 1998

[51] Int. Cl.[7] ..... B41J 2/145; B41J 2/15; B41J 29/38; B41J 2/01

[52] U.S. Cl. ..... 347/40; 347/9; 347/14; 347/105

[58] Field of Search ..... 347/40, 8, 16, 347/14, 104, 105, 9

[56] References Cited

U.S. PATENT DOCUMENTS

| | | | |
|---|---|---|---|
| 4,401,991 | 8/1983 | Martin | 347/41 |
| 4,675,692 | 6/1987 | Goshima et al. | 347/180 |
| 4,703,331 | 10/1987 | Stevens, Jr. | 347/16 |
| 4,965,593 | 10/1990 | Hickman | 347/12 |
| 4,999,646 | 3/1991 | Trask | 347/41 |
| 5,109,233 | 4/1992 | Nishikawa | 347/12 |
| 5,512,922 | 4/1996 | Paton | 347/12 |
| 5,654,744 | 8/1997 | Nicoloff, Jr. et al. | 347/43 |
| 5,692,108 | 11/1997 | Donahue | 395/108 |
| 5,801,722 | 9/1998 | Ueda et al. | 347/16 |
| 5,838,338 | 11/1998 | Olson | 347/8 |
| 5,870,117 | 2/1999 | Moore | 347/37 |

*Primary Examiner*—Thinh Nguyen
*Attorney, Agent, or Firm*—John A. Brady

[57] ABSTRACT

A thermal ink jet printer has two columns of nozzles in its nozzle plate parallel to the direction of motion of each sheet of media. When the sheet of media is thin such as bond paper having a thickness of 0.1 mm, for example, all of the nozzles are available for printing. When the sheet of media is thick such as an envelope having a thickness of 0.5 mm, for example, one-fourth of the nozzles are available for printing, and these are the nozzles first passed by the sheet of media during its advancement. Each sheet of media has the same feed rate although it takes four times as long for the thick sheet of media to be printed.

16 Claims, 2 Drawing Sheets

THERMAL INK JET PRINTER

FIELD OF THE INVENTION

This invention relates to a thermal ink jet printer having improved print quality and, more particularly, to a thermal ink jet printer in which sheets of media of varying thicknesses may be printed without affecting print quality.

BACKGROUND OF THE INVENTION

To obtain improved print quality in a thermal ink jet printer, a substantially uniform gap is desired between a nozzle plate surface having nozzles through which the ink is ejected as droplets and a sheet of media to which the droplets are applied by transverse motion of the nozzle plate relative to the sheet of media while the sheet of media is stationary. During advancement of the sheet of media relative to the nozzles in the nozzle plate, no printing occurs.

With relatively thin sheets of media such as bond paper having a thickness of about 0.1 mm, for example, buckling of the leading edge of the sheet of media by its engagement with an inclined surface maintains a substantially uniform gap between the sheet of media and the nozzle plate surface. That is, absorption of the selectively applied ink droplets by a buckling sheet of media does not create an uncontrolled buckling of the sheet of media to significantly vary the gap between the sheet of media and the nozzle plate surface.

Because of the relatively small gap, approximately 1 mm, a relatively thick sheet of media such as an envelope having a thickness of about 0.5 mm, for example, will buckle; the sheet will either engage the nozzle plate surface or be very close thereto so as to graze it. With the number of nozzles utilized and the speed of advancement of the sheet of media necessary for satisfactory throughput for a relatively thin sheet of media such as bond paper, for example, the relatively thick sheet of media will not have the ink dry thereon when it grazes or engages the nozzle plate surface adjacent where it is buckled. Accordingly, this grazing or engaging of the relatively thick sheet of media with the nozzle plate surface produces ink smear or smudge.

Therefore, the substantially uniform gap remains with printing on a relatively thin sheets of media. However, the gap does not remain substantially uniform with relatively thick sheets of media such as envelopes, for example.

SUMMARY OF THE INVENTION

The present invention solves the problem of preventing smudging or smearing of the ink deposited on a relatively thick sheet of media such as an envelope, for example. To accomplish this, it is necessary to reduce the throughput of the envelopes in comparison with the throughput of bond paper, for example. However, this reduction in throughput enables the print quality on the envelopes to remain substantially the same as the print quality on the bond paper.

The throughput is reduced preferably by utilizing less than one-half of all the nozzles in each column extending in the direction of travel of the sheet of media when the sheet of media is relatively thick. While the specific number of the nozzles that are not utilized in each column depends upon the thickness of the sheet of media, it has been found that utilizing one-fourth of all the nozzles in each column for printing on an envelope having a thickness of 0.5 mm, for example, results in satisfactory print quality. Thus, with one hundred eight nozzles in each column and only two columns, only the first twenty seven of the nozzles in each of the two columns are employed during each traverse of the relatively thick sheet of media by the nozzles.

This reduction in the number of the nozzles available to be used in printing the relatively thick sheet of media allows the ink deposited on an area of the relatively thick sheet of media to dry before the area of the relatively thick sheet of media having the ink grazes or engages the nozzle plate surface. At the same time, the relatively thin sheets of media such as bond paper, for example, still have the satisfactory throughput and the satisfactory print quality.

An object of this invention is to provide a thermal ink jet printer in which the number of nozzles available for printing on a sheet of media during traverse of the sheet of media by the nozzles is dependent upon the thickness of the sheet of media on which printing is to occur.

Another object of this invention is to provide a thermal ink jet printer in which a desired print quality is obtained irrespective of the thickness of the sheet of media on which printing is to occur.

Other objects of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
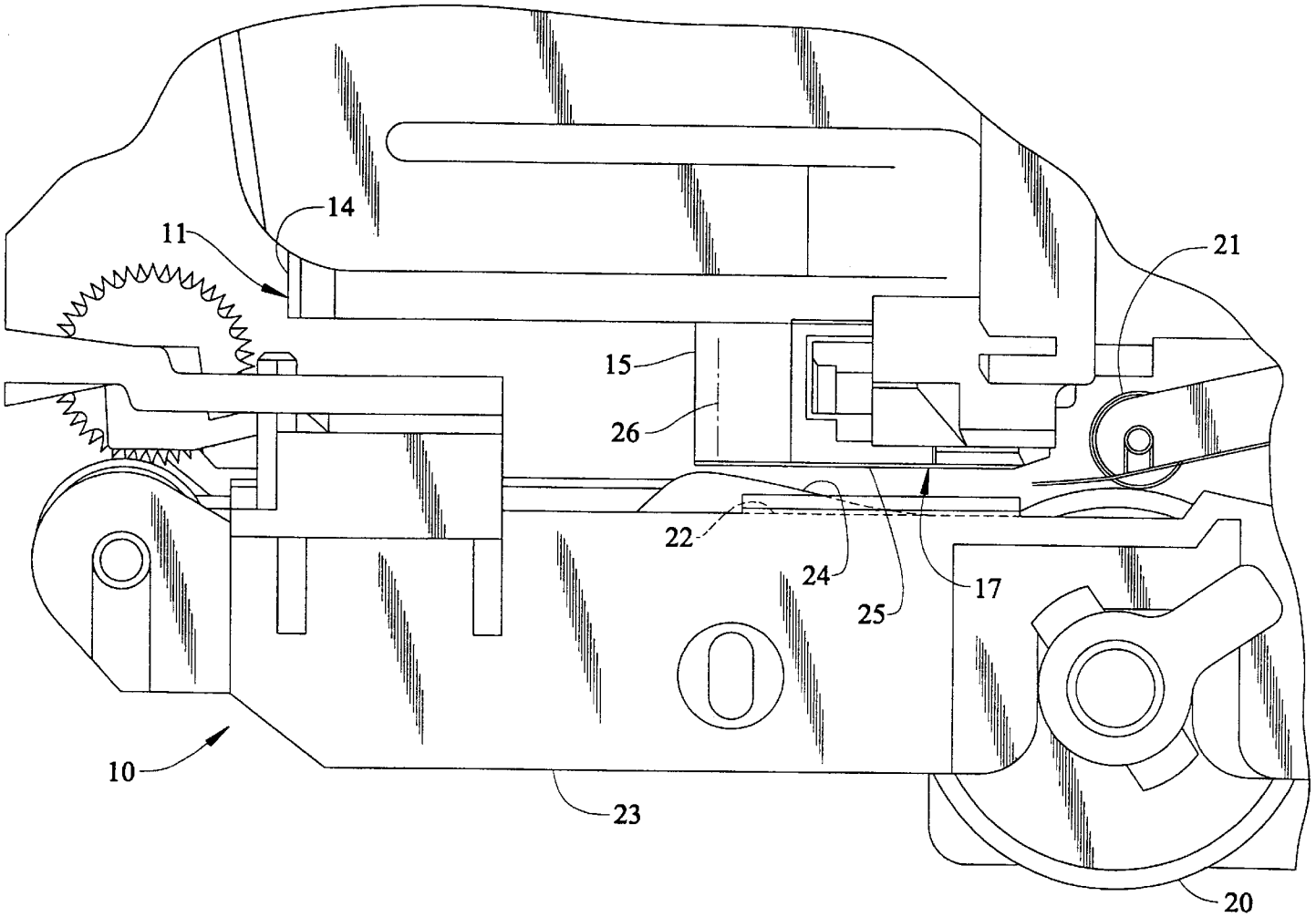
FIG. 1 is a schematic side elevational view of a portion of a thermal ink jet printer through which sheets of media are advanced.
Figure 2:
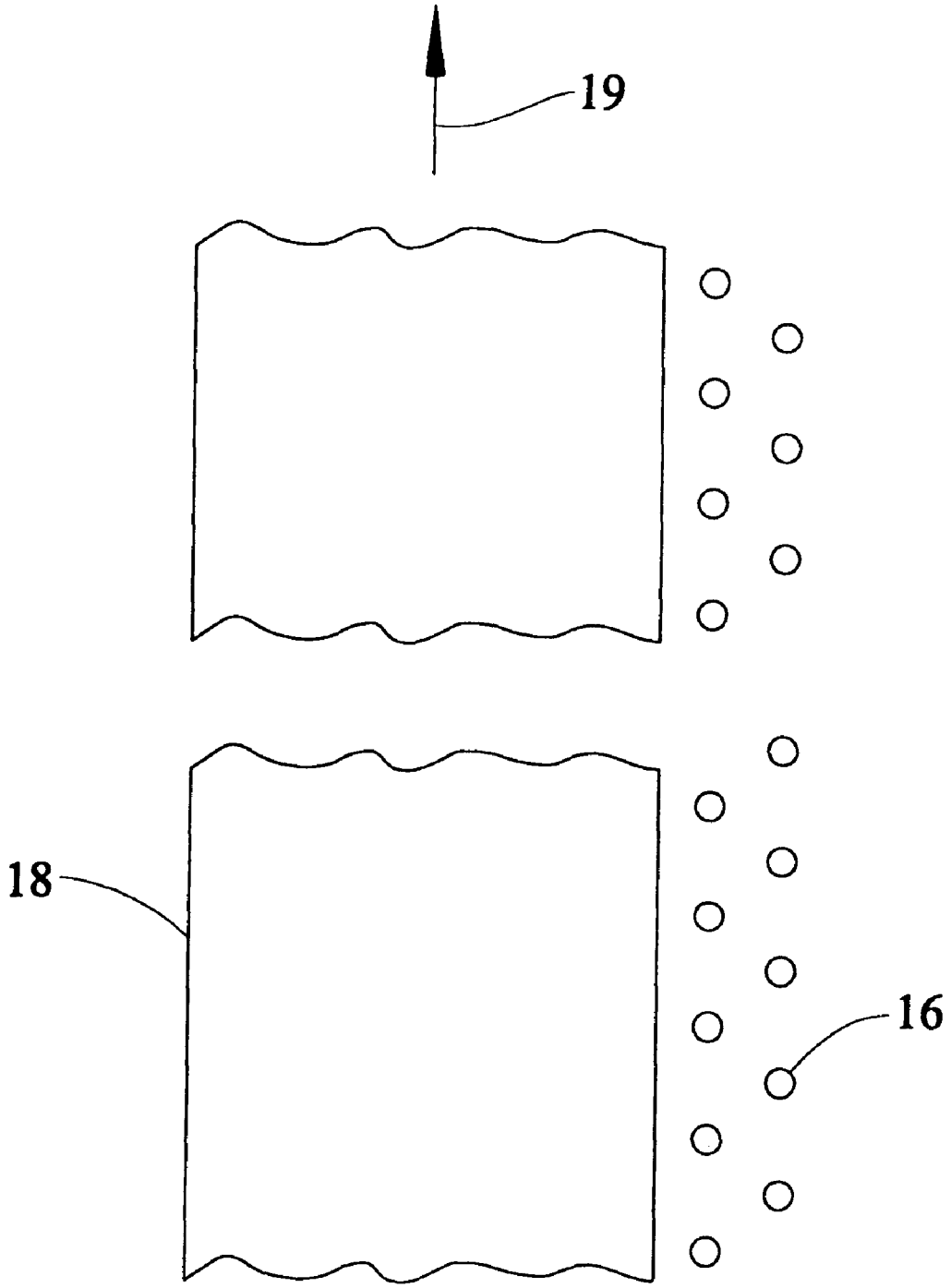
FIG. 2 is schematic plan view of a sheet of media and ink jet nozzles of the thermal ink jet printer of FIG. 1.

Referring to the drawings and particularly FIG. 1, there is shown a portion of a thermal ink jet printer 10 including an ink cartridge 11. The cartridge 11 has an ink reservoir 14 communicating through a tower 15 of the cartridge 11 with nozzles 16 (see FIG. 2) in a nozzle plate 17 (see FIG. 1). In the well-known manner, ink is separately and selectively heated in a passage (not shown) for each of the nozzles 16 (see FIG. 2) in the nozzle plate 17 (see FIG. 1) to produce ink droplets for application to a sheet 18 (see FIG. 2) of media such as bond paper, for example.

Each of the sheets 18 of media is advanced in the direction of an arrow 19 by a feed roll 20 (see FIG. 1). The cartridge 11 is mounted for movement perpendicular to the direction of the arrow 19 (see FIG. 2) when the sheet 18 of media is stationary. Thus, the nozzles 16 are moved incrementally over the width of the sheet 18 of media. There are preferably only two of the columns of the nozzles 16 with each of the columns preferably having one hundred eight of the nozzles 16 therein.

The feed roll 20 (see FIG. 1) has a spring loaded pressure roll 21 urged thereagainst to hold the sheet 18 (see FIG. 2) of media therebetween for advancement relative to the nozzle plate 17 (see FIG. 1). As the sheet 18 (see FIG. 2) of media is advanced to the left in FIG. 1, it rides along a substantially horizontal floor 22 of a mid-frame 23 of the thermal ink jet printer 10 until its leading edge strikes an inclined surface 24 of the mid-frame 23. The inclined surface 24, which extends upwardly from the floor 22, buckles the advancing sheet 18 (see FIG. 2) of media so that the ink droplets supplied through the nozzles 16 of the nozzle plate 17 (see FIG. 1) will not create any buckling of the sheet 18 (see FIG. 2) of media as the ink is absorbed by the sheet 18 of media.

If the sheet 18 of media is an envelope, then the sheet 18 of media would strike bottom surface 25 (see FIG. 1) of the nozzle plate 17. Because each of the columns of the nozzles 16 (see FIG. 2) extends to almost the upper end of the inclined surface 24 (see FIG. 1) as indicated by a phantom line 26, the sheet 18 (see FIG. 2) of media will strike or graze the nozzle plate 17 (see FIG. 1) prior to the ink drying.

Accordingly, when the sheet 18 (see FIG. 2) of media is relatively thick, it has been determined that the ink can dry on the sheet 18 of media if the number of the nozzles 16 in each column available for selective use is substantially reduced. For example, satisfactory print quality is obtained with an envelope having a thickness of 0.5 mm in comparison with bond paper having a thickness of 0.1 mm by using only the first one-fourth (twenty seven) of the one hundred eight nozzles 16 in each of the two columns in the direction of motion of the sheet 18 of media as indicated by the arrow 19. Of course, by using only one-fourth (twenty seven) of the one hundred eight nozzles 16 during each traverse of the sheet 18 of media by the nozzles 16 while the sheet 18 of media is not being advanced, this significantly decreases the throughput to one-fourth of that obtained with the bond paper. However, the same print quality is obtained with this reduced throughput.

It should be understood that other than one-fourth (twenty seven) of the one hundred eight nozzles 16 in each column might be employed depending on the thickness of the sheet 18 of media. However, it would be less than one-half of the nozzles 16 in each column.

Accordingly, software in the thermal ink jet printer 10 (see FIG. 1) is utilized to select the sheet 18 (see FIG. 2) of media of a specific thickness on which printing is to occur. When the thickness of the selected sheet 18 of media is equal to or exceeds a predetermined thickness, the software allows only a predetermined portion (This is less than one-half of the nozzles 16 in each column.) of the nozzles 16 in each column to be utilized to produce satisfactory print quality. When the sheet 18 of media has a thickness of 0.5 mm, the predetermined portion is preferably the first one-fourth of the nozzles 16 in each column.

Thus, when a user selects an envelope, for example, to be printed, the software automatically allows only the predetermined portion of the nozzles 16 to be employed for printing. This increases the time for the ink to dry on the sheet 18 of media before it reaches the inclined surface 24 (see FIG. 1).

The software could be designed to provide a different number of the nozzles 16 (see FIG. 2) for different thicknesses of the sheets 18 of media. It would only be necessary to determine the maximum number of the nozzles 16 that would still enable the ink to have dried on an area of the sheet 18 of media when the area of the sheet 18 of media grazes or strikes the nozzle plate 17 (see FIG. 1).

While two columns of the nozzles 16 (see FIG. 2) have been shown and described, it should be understood that there could be only one column or more than three. However, one column is not as efficient while more than two columns creates some difficult problems for the software.

It should be understood that the use of one-fourth of the available nozzles 16 during each transverse motion of the nozzles 16 across the sheet 18 of media results in it taking four times as long to print the sheet 18 of media as when all of the available nozzles 16 are employed. However, the rate of feeding in each interval of advancement of the sheet 18 of media is the same as when all of the available nozzles 16 are utilized because the motor (not shown) driving the feed roll 20 (see FIG. 1) is operated at the same speed. Accordingly, this invention allows the same motor system to be used without changing the hardware or software.

An advantage of this invention is that envelopes can be printed by a thermal ink jet printer without ink smear to obtain the same print quality as is obtained with relatively thin sheets of media such as bond paper, for example. Another advantage of this invention is that the rate of advancement of each sheet of media, irrespective of its thickness, is the same.

For purposes of exemplification, a preferred embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A method of printing a sheet of media in a software controlled ink jet printer without ink smearing including:

moving the sheet of media past all available nozzles;

utilizing all available nozzles for selective printing use when a sheet of media having a thickness less than a predetermined thickness is selected for advancement relative to the available nozzles;

selecting only a predetermined portion of the available nozzles for selective printing use when a sheet of media having a thickness equal to or exceeding the predetermined thickness is selected for advancement relative to the available nozzles, said predetermined portion being a portion first passed by said moving the sheet; and moving all of the available nozzles transversely to the direction of motion of the sheet of media when the sheet of media is stationary for applying ink to the sheet of media.

2. The method according to claim 1 in which said predetermined portion of the available nozzles is less than one-half of the available nozzles in the direction of motion of the sheet of media and is the first available nozzles.

3. The method according to claim 1 in which the predetermined portion of the available nozzles is the first one-fourth of the available nozzles in the direction of motion of the sheet of media.

4. The method according to claim 3 in which selection of the predetermined portion is automatically made by software in accordance with the selection by a user of a sheet of media of a specific thickness on which printing is to occur.

5. The method according to claim 4 in which all available nozzles are arranged in at least two columns of equal length extending in the direction of motion of the sheet of media.

6. The method according to claim 1 in which selection of the predetermined portion is automatically made by software in accordance with the selection by a user of a sheet media of specific thickness on which printing is to occur.

7. The method according to claim 6 in which all available nozzles are arranged in at least two columns of equal length extending in the direction of motion of the sheet of media.

8. The method according to claim 1 in which all available nozzles are arranged in at least two columns of equal length extending in the direction of motion of the sheet of media.

9. A ink jet printer including:

a plurality of ink jet available nozzles for selective printing use;

advancing means for advancing a sheet of media orthogonal to the direction in which said nozzles traverse the sheet of media while the sheet of media is stationary;

software controlled means for determining which of said nozzles is to be utilized during each traverse of the sheet of media by said nozzles in accordance with a thickness of the advancing sheet of media;

and software controlled selecting means for selecting only a predetermined portion of said available nozzles for selective printing use when said sheet of media has the thickness equal to or exceeding a predetermined thickness, said predetermined portion of said available nozzles being passed first by the sheet of media during the advancement of the sheet of media, said predetermined portion of said available nozzles being positioned to eject ink from nozzles of said predetermined portion to become dry on the sheet of media prior to advancing past all of said available nozzles.

10. The thermal ink jet printer according to claim 9 in which said predetermined portion of said available nozzles is less than one-half of said available nozzles in the direction of advancement of the sheet of media by said advancing means and is the first of said available nozzles.

11. The thermal ink jet printer according to claim 9 in which said predetermined portion of said available nozzles is the first one-fourth of said available nozzles in the direction of advancement of the sheet of media by said advancing means.

12. The thermal ink jet printer according to claim 11 in which said selecting means includes software receiving an input of a selected sheet of media by a user to determine if said predetermined portion of said available nozzles or all of said available nozzles is to be used for printing on the selected sheet of media.

13. The thermal ink jet printer according to claim 12 in which said available nozzles are arranged in at least two columns of equal length extending in the direction of advancement of the sheet of media.

14. The thermal ink jet printer according to claim 9 in which said selecting means includes software receiving an input of a selected sheet of media by a user to determine if said predetermined portion of said available nozzles or all of said available nozzles is to be used for printing on the selected sheet of media.

15. The thermal ink jet printer according to claim 14 in which said available nozzles are arranged in at least two columns of equal length extending in the direction of advancement of the sheet of media.

16. The thermal ink jet printer according to claim 9 in which said available nozzles are arranged in at least two columns of equal length extending in the direction of advancement of the sheet of media.

* * * * *